US006250341B1

(12) United States Patent
Helwig

(10) Patent No.: US 6,250,341 B1
(45) Date of Patent: Jun. 26, 2001

(54) SUPER PEGS

(76) Inventor: Gary L. Helwig, 20213 Sweet Meadow La., Laytonsville, MD (US) 20882

( * ) Notice: Subject to any disclaimer, the term of this patent is extended or adjusted under 35 U.S.C. 154(b) by 0 days.

(21) Appl. No.: 09/708,034

(22) Filed: Nov. 8, 2000

Related U.S. Application Data

(63) Continuation of application No. 09/273,348, filed on Mar. 22, 1999, now abandoned.

(51) Int. Cl.[7] ..... B21F 1/00
(52) U.S. Cl. ..... 140/92.1; 72/457
(58) Field of Search ..... 140/71 R, 92.1, 140/102, 102.5, 106, 124; 72/148, 457, 478; 29/896.4, 896.41

(56) References Cited

U.S. PATENT DOCUMENTS 485,964 * 11/1892 Mendelson ..... 140/71 R
620,449 * 2/1899 Hart ..... 140/124
1,042,112 * 10/1912 Hartman ..... 140/102
3,538,736 * 11/1970 Nygren ..... 72/457
5,878,788 * 3/1999 Gurry ..... 140/92.1

* cited by examiner

*Primary Examiner*—Lowell A. Larson
(74) *Attorney, Agent, or Firm*—Patent & Trademark Services; Joseph H. McGlynn

(57) ABSTRACT

A wire bending tool kit which has a plate with a plurality of apertures and a plurality of pegs of different sizes which can be inserted into selected apertures in the plate. The pegs have structure for holding wire onto the pegs. In addition, the kit contains a plurality of spacers which can be placed over one or more of the pegs to produce different shapes in the wire as it is being bent. Also, one of the pegs has an aperture therein which allows an end of a wire to be inserted to produce spiral shapes.

11 Claims, 1 Drawing Sheet

FIG. 1
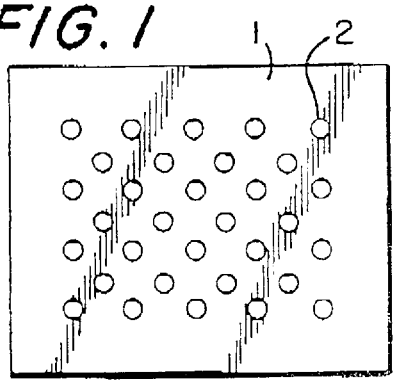
FIG. 2
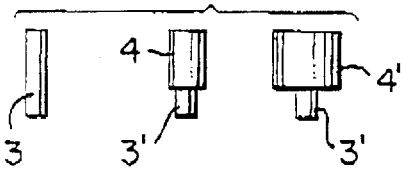
FIG. 3
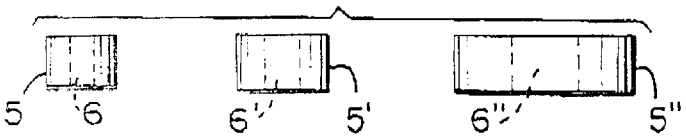
FIG. 5
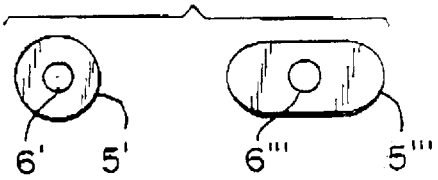
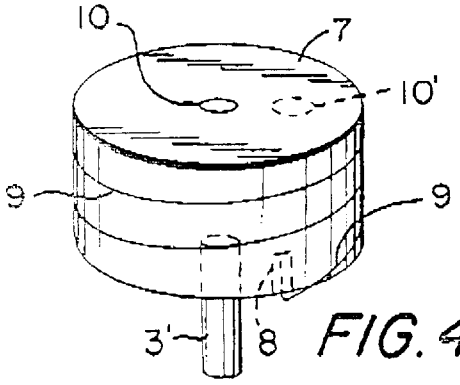
FIG. 4
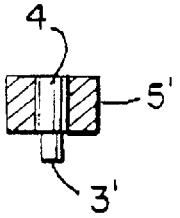
FIG. 6
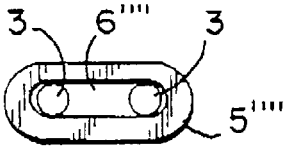
FIG. 9
FIG. 8
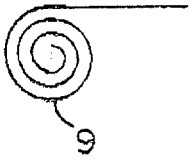
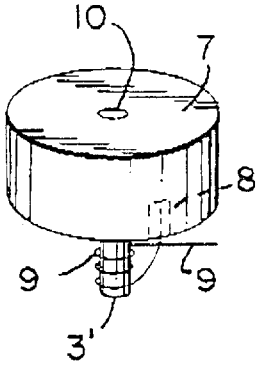
FIG. 7

SUPER PEGS

This is a continuation of application Ser. No. 09/273,348, filed Mar. 22, 1999, now abandoned.

BACKGROUND OF THE INVENTION

This invention relates, in general, to wire bending tools, and, in particular, to wire bending tools that make it easier to form different shapes.

DESCRIPTION OF THE PRIOR ART

In the prior art various types of wire bending tools have been proposed. For example, U.S. Pat. No. 2,530,576 to Gregory discloses a spring winder which has a first member around which the wire is wrapped, and a second member at a right angle to the first member. The second member has an aperture to receive the end of the wire and turning the first member coils the wire around the first member.

U.S. Pat. No. 2,907,368 to Barnes discloses a wire bending jig with a plurality of different size pegs placed in apertures in a plate and a wire is bent around the different size pegs to produce different shapes.

British patent No. 880,382 to Wood discloses a wire bending jig which has a non symmetrical spacer around which a wire can be bent to produce a specific shape in the wire.

SUMMARY OF THE INVENTION

The present invention is directed to a wire bending tool kit which has a plate with a plurality of apertures and a plurality of pegs of different sizes which can be inserted into selected apertures in the plate. The pegs have structure for holding wire onto the pegs. In addition, the kit contains a plurality of spacers which can be placed over one or more of the pegs to produce different shapes in the wire as it is being bent. Also, one of the pegs has an aperture therein which allows an end of a wire to be inserted to produce spiral shapes.

It is an object of the present invention to provide a new and improved wire bending tool kit.

It is an object of the present invention to provide a new and improved wire bending tool kit which will allow jewelry wire to be bent easily and quickly.

It is an object of the present invention to provide a new and improved wire bending tool kit which will allow wire to be bent in different shapes.

It is an object of the present invention to provide a new and improved wire bending tool kit which comprises pegs around which the wire will be bent and the pegs have structure to hold the wire as it is bent into different shapes.

These and other objects and advantages of the present invention will be fully apparent from the following description, when taken in connection with the annexed drawings.

BRIEF DESCRIPTION OF THE DRAWINGS

FIG. 1 is a plan view of the plate with apertures to receive the various pegs of the present invention.

FIG. 2 is a side view of some of the pegs used in the present invention.

FIG. 3 is a side view of some of the spacers used in the present invention.

FIG. 4 is a perspective view of the spiral forming peg of the present invention.

FIG. 5 is a top view of some of the spacers used with the present invention.

FIG. 6 is a view showing one of the spacers of FIG. 3 in place on one of the pegs of FIG. 2.

FIG. 7 is a view showing a modified form of making a spiral using the spiral forming peg of the present invention.

FIG. 8 is a top view showing a spiral made with the spiral forming peg of FIG. 7.

FIG. 9 shows a modified spacer.

DESCRIPTION OF THE PREFERRED EMBODIMENT

Referring now to the drawings in greater detail, FIGS. 1–5 show the various elements which are part of the wire bending kit of the present invention. FIG. 1 shows the plate 1 which forms the base used with the other elements in FIGS. 2–5. The plate 1 is preferably made from a transparent material so a pattern could be placed on the bottom of the plate to guide the user in bending the wire into a specific pattern, although other materials could be used. Since the various pegs used with the present invention will be placed into the apertures 2, which are on the top of the plate 1, manipulating the pegs and the wire, which will be passed around the pegs, will not damage the pattern on the bottom of the plate 1. It should be noted that, while a transparent material is the preferred material for the plate 1, other materials, including non-transparent materials such as metal, can be used without departing from the scope of the invention.

The plate 1, as shown in FIG. 1, has a plurality of apertures 2 extending into the plate from the top of the plate. It should be noted that the arrangement of apertures shown in FIG. 1, is merely for illustrational purposes, and other arrangements can be used without departing from the scope of the invention. Each aperture 2 will have a diameter which will accept the peg 3, shown in FIG. 2, in a friction fit so the peg will be firmly held in the aperture 2. Although only one peg 3 is shown, it is understood that a plurality of the pegs 3 will be provided in the kit of the present invention, so a user can place the pegs in any desired pattern in the base 1. Once the pegs are in the desired pattern, the user can bend wire (not shown) around the pegs to form various pieces of jewelry or other items.

Other pegs included in the kit of the present invention are shown at 4 and 4' in FIG. 2. The pegs 4, 4' have a lower portion 3' which is the same diameter as the peg 3 so it will fit snugly in the apertures 2 of the plate 1. The upper portion of the pegs 4, 4' have different diameters so a user can form different dimensions in their wire designs simply by bending the wire around pegs of different diameters. It should be noted that only two pegs 4, 4' are shown in FIG. 2, however, more than two pegs with different diameters will be included in the kit to make it as versatile as possible.

The spacers 5, 5', 5", shown in FIG. 3 will be used in conjunction with the pegs 3, 4, 4' shown in FIG. 2. The spacers 5, 5', 5" will have different outside diameters, as shown in FIG. 3, and the diameter of the inner aperture 6, 6', 6" will also be a different dimension. This will allow one of the spacers 5, 5', 5" to be placed over one of the pegs 3, 4, 4' with the apertures 6, 6', 6" fitting snugly over the pegs 3, 4, 4'. This will allow the user a great deal of freedom in bending the wire around the pegs to achieve different shapes in the final jewelry piece. Again, only three spacers are shown in FIG. 3 for illustrational purposes, but more than three spacers will be provided in the kit.

FIG. 5 shows a top view of some of the spacers provided in the kit of the present invention. It should be noted that spacer 5' is circular while spacer 5''' has an oval shape. Again, this is merely for illustrational purposes, and the spacers can have a variety of shapes without departing from the scope of the invention.

FIG. 6 shows one of the spacers 5' from FIG. 3 placed over the peg 4 from FIG. 2.

FIG. 4 shows another peg 7 which will be provided in the kit of the present invention. The peg 7 will have a lower portion 3' which will fit snugly in the apertures 2 in the plate 1. The upper portion of the peg 7 will preferably be circular, however, other shapes can be used. The lower surface of the upper portion of the peg 7 will have an aperture 8 extending into the lower surface. As shown in FIG. 4, the aperture 8 extends only part way through the upper portion of the peg, however, it could extend completely through the upper surface of the peg 7 if desired.

In use, an end of the wire 9 will be inserted into the aperture 8 before the lower portion 3' is inserted into one of the apertures 2 on the plate 1. When the peg is so inserted, the lower surface of the upper portion of the peg 7, along with the upper surface of the plate 1 and the aperture 8 will trap the end of the wire 9, thus holding the wire as it is wrapped around the upper portion of the peg. The user can then rotate the peg 7 while at the same time guiding the wire 9 around the outer circumference of the peg 7 as shown in FIG. 4. In this manner, a user can form spirals easily and quickly. In addition, the shape of each spiral formed will be of a consistent size.

Also, as shown by the dotted lines 10', the aperture does not have to be centered in the top surface of the peg 7. It can be placed at any position on the surface, again to offer greater versatility in forming wire pieces.

It should be noted that only one of the pegs 7 is shown in the drawings, however, it should be understood that different size pegs 7 can be used to allow the forming of different shaped and different sized spirals.

FIG. 7 shows a modified manner of using the peg of FIG. 4 to form spirals. In FIG. 7 the wire is inserted into the aperture 8, and the wire 9 is guided around the portion 3' instead of the outer circumference of 7. In order to wind the wire 9 about the peg 3' the peg could be inserted only partially into the aperture 2 on the plate 1 to allow a space between the top of the plate 1 and the bottom of the peg 7 to receive the spiraled wire, or a peg 3' with a longer length could be used so there will be room for the spiral between the bottom surface of 7 and the top surface of the plate 1.

As the wire is spiraled, in the FIG. 7 device, the spiral will take the shape shown in FIG. 8. It should be noted that the wire spirals will all be in substantially the same plane with the center being the peg 3'. The two methods of making spirals, as shown in FIGS. 4 and 7 allow the user to easily and quickly make spirals of different sizes.

In FIG. 9 a modified spacer 5'''' is shown, which is similar to the spacers shown in FIG. 5, except the aperture 6'''' through the spacer is large enough to pass over two pegs 3. It should be noted that the spacer 6'''' is shown as being oval, however, this shape is not necessarily the only one that could be used. Other shapes such as, but not limited to, circular, square, or hexagonal could also be used. In addition, the spacer 5'''' could be formed to pass over more than two pegs 3, or it could be made to pass over any number of the other pegs, such as 4, 4' shown in FIG. 2.

Although the Super Pegs and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A kit for forming decorative pieces from wire, said kit comprising:

a plate having a length, width and a thickness, said plate having a top surface and a bottom surface, a plurality of apertures extending into said top surface of said plate, means for forming a design on said top surface of said plate, said means comprising a plurality of pegs, each of said pegs having an upper portion and a lower portion, said lower portion of said pegs being of a size to fit into said apertures on said top surface of said plate, said upper portion of said pegs being of different sizes, and a lower surface of said upper portion of said pegs having means for holding at least a portion of said wire on said upper portion of said pegs.

2. The kit for forming decorative pieces from wire as claimed in claim 1, wherein said kit also includes spacers, said spacers having an aperture therein, said apertures being of a size to fit around said upper portion of said pegs.

3. The kit for forming decorative pieces from wire as claimed in claim 2, wherein an outer surface on said spacers is circular.

4. The kit for forming decorative pieces from wire as claimed in claim 2, wherein said outer surface on said spacers is oval.

5. The kit for forming decorative pieces from wire as claimed in claim 2, wherein at least one of said spacers has an aperture therein which is large enough to fit around the upper portions of at least two pegs.

6. The kit for forming decorative pieces from wire as claimed in claim 1, wherein at least one of said pegs has an upper portion and a lower portion, and a lower surface on said upper portion has means for securing an end of a wire therein.

7. The kit for forming decorative pieces from wire as claimed in claim 6, wherein said means for securing an end of a wire is an aperture.

8. The kit for forming decorative pieces from wire as claimed in claim 6, wherein said aperture in said lower surface of said upper portion of said at least one peg extends at least partially through said upper portion.

9. The kit for forming decorative pieces from wire as claimed in claim 6, wherein said upper portion has a top surface, aperture means in said top surface for receiving at least one additional peg.

10. The kit for forming decorative pieces from wire as claimed in claim 9, wherein said aperture means is centered in said top surface.

11. The kit for forming decorative pieces from wire as claimed in claim 9, wherein said aperture means is not centered in said top surface.

* * * * *